US009926947B2

(12) United States Patent
Villar et al.

(10) Patent No.: US 9,926,947 B2
(45) Date of Patent: Mar. 27, 2018

(54) AIR-TO-HYDRAULIC FLUID PRESSURE AMPLIFIER

(71) Applicant: Montana Hydraulics, LLC, Helena, MT (US)

(72) Inventors: Chris Villar, Georgetown, TX (US); Matthew Warrington, Helena, MT (US)

( * ) Notice: Subject to any disclaimer, the term of this patent is extended or adjusted under 35 U.S.C. 154(b) by 531 days.

(21) Appl. No.: 14/700,886

(22) Filed: Apr. 30, 2015

(65) Prior Publication Data

US 2015/0322973 A1 Nov. 12, 2015

Related U.S. Application Data

(66) Substitute for application No. 61/991,038, filed on May 9, 2014.

(51) Int. Cl.

| | |
|---|---|
| ***F04B 9/133*** | (2006.01) |
| ***F15B 13/02*** | (2006.01) |
| ***F15B 3/00*** | (2006.01) |
| ***F04B 9/131*** | (2006.01) |
| *F15B 13/04* | (2006.01) |

(52) U.S. Cl.

CPC ..... *F15B 13/026* (2013.01); *F04B 9/131* (2013.01); *F04B 9/133* (2013.01); *F15B 3/00* (2013.01); *F15B 13/0407* (2013.01)

(58) Field of Classification Search

CPC ..... F15B 13/026; F15B 3/00; F15B 13/0407; F03C 1/0076; F03C 1/02; F03C 1/06

See application file for complete search history.

(56) References Cited

U.S. PATENT DOCUMENTS

| | | | | |
|---|---|---|---|---|
| 3,811,795 | A * | 5/1974 | Olsen | F03C 1/10 417/397 |
| 4,407,202 | A | 10/1983 | McCormick | |
| 5,261,333 | A | 11/1993 | Miller | |
| 6,660,065 | B2 * | 12/2003 | Byrd | B01D 53/047 95/117 |
| 7,051,661 | B2 | 5/2006 | Herzog et al. | |
| 7,328,661 | B1 | 2/2008 | Allen et al. | |
| 7,389,732 | B2 | 6/2008 | Taylor | |
| 7,735,426 | B2 | 6/2010 | Creighton et al. | |
| 7,891,304 | B2 | 2/2011 | Herzog et al. | |
| 8,701,565 | B2 | 4/2014 | Creighton et al. | |
| 8,915,194 | B2 | 12/2014 | Creighton et al. | |
| 2005/0056185 | A1 | 3/2005 | Herzog et al. | |
| 2005/0263032 | A1 | 12/2005 | Taylor | |

(Continued)

*Primary Examiner* — F. Daniel Lopez
*Assistant Examiner* — Abiy Teka
(74) *Attorney, Agent, or Firm* — Antoinette M. Tease

(57) ABSTRACT

An air-to-hydraulic fluid pressure amplifier comprising an air cylinder having an internal reciprocating air piston; a first hydraulic cylinder having a first valve fitting and a first internal hydraulic ram that is slidably positioned within the first hydraulic cylinder; a second hydraulic cylinder having a second valve fitting and a second internal hydraulic ram that is slidably positioned within the second hydraulic cylinder; a first flow control valve and a second flow control valve; a first plunger-operated pilot valve and a second plunger-operated pilot valve. Each of the first and second plunger-operated pilot valves comprises an inlet port, an outlet port, a plunger, a barrel, and a compression spring.

14 Claims, 10 Drawing Sheets

(56) References Cited

U.S. PATENT DOCUMENTS

| | | | | |
|---|---|---|---|---|
| 2007/0084378 | A1 | 4/2007 | Creighton et al. | |
| 2008/0236438 | A1 | 10/2008 | Herzog et al. | |
| 2010/0089063 | A1* | 4/2010 | McBride | F15B 11/032 60/682 |
| 2010/0275811 | A1 | 11/2010 | Creighton et al. | |
| 2010/0307156 | A1* | 12/2010 | Bollinger | H02J 15/006 60/682 |
| 2012/0118195 | A1 | 5/2012 | Creighton et al. | |

* cited by examiner

AIR-TO-HYDRAULIC FLUID PRESSURE AMPLIFIER

CROSS-REFERENCE TO RELATED APPLICATION

This application claims priority back to U.S. Patent Application No. 61/991,038 filed on May 9, 2014, the contents of which are incorporated herein by reference.

BACKGROUND OF THE INVENTION

1. Field of the Invention

The present invention relates to the field of devices that produce pressurized hydraulic fluids, and more particularly, to devices that utilize compressed air to drive a reciprocating air piston in order to produce pressurized hydraulic fluid for purposes such as actuating hydraulic lift cylinders.

2. Description of the Related Art

Although there are a number of issued U.S. patents and patent applications that describe air-to-hydraulic fluid pressure amplifiers, none of these prior-art inventions includes the novel features of the present invention, which comprises dual hydraulic rams, custom-designed end-of-stroke sensors for the air piston, and an easily replaceable annular seal for the hydraulic rams.

U.S. Pat. No. 4,407,202 (McCormick, 1983) discloses a hydraulically activated dumping system for railway cars. In one embodiment, the invention employs a booster pump that is comprises a large bore air cylinder connected to a small bore hydraulic cylinder for the purpose of using low-pressure compressed air to provide high-pressure hydraulic fluid. The air cylinder is reciprocated to pressurize the hydraulic fluid. The invention comprises a single hydraulic ram, which produces one pressure stroke of hydraulic fluid for each back-and-forth cycle of the piston in the air cylinder.

U.S. Pat. No. 5,261,333 (Miller, 1993) discloses an automated ballast door mechanism for use with a railroad hopper car. The invention comprises pressurized hydraulic fluid, which is produced by an air-powered motor that drives a hydraulic fluid pump. The details of the motor and pump are not disclosed.

U.S. Pat. No. 7,051,661 (Herzog et al., 2006), U.S. Pat. No. 7,735,426 (Creighton et al., 2010), U.S. Pat. No. 7,891,304 (Herzog et al., 2011) and U.S. Pat. No. 8,915,194 (Creighton et al., 2014) are related patents that disclose discharge control systems for railroad cars. Some embodiments of the inventions disclosed in these patents employ air cylinder actuators and hydraulic motors, but no air-to-hydraulic fluid pressure amplifiers are described.

U.S. Pat. No. 7,328,661 (Allen et al., 2008) discloses a control device for a railroad car door. This invention comprises an air piston actuator but does not comprise hydraulic components.

U.S. Pat. No. 7,389,732 (Taylor, 2008) discloses a mechanism for selectively operating hopper doors of a railroad car. This invention does not comprise hydraulic components.

U.S. Pat. No. 6,192,804 (Snead, 2001) discloses a hydraulically actuated railway car dumping system that comprises a pneumatic-to-hydraulic pressure amplifier. The pressure amplifier of this invention comprises two pneumatic pistons in two separate pneumatic cylinders that are linked to a single, double-acting hydraulic pump via a pivoting lever arm.

U.S. Pat. No. 8,701,565 (Creighton et al., 2014) discloses devices for powering railroad car doors. In one embodiment, an air motor is used to drive a hydraulic pump (FIG. 13), but no details of an air-to-hydraulic pressure amplifier are disclosed.

BRIEF SUMMARY OF THE INVENTION

An air-to-hydraulic fluid pressure amplifier comprising: an air cylinder having an internal reciprocating air piston; a first hydraulic cylinder having a first valve fitting and a first internal hydraulic ram that is slidably positioned within the first hydraulic cylinder; a second hydraulic cylinder having a second valve fitting and a second internal hydraulic ram that is slidably positioned within the second hydraulic cylinder; a first flow control valve and a second flow control valve; a first plunger-operated pilot valve and a second plunger-operated pilot valve; wherein a proximal end of the first hydraulic ram is rigidly attached to a first face of the air piston so that a longitudinal axis of the first hydraulic ram is collinear with a longitudinal axis of the air piston, and wherein a proximal end of the second hydraulic ram is rigidly attached to a second face of the air piston so that a longitudinal axis of the second hydraulic ram is collinear with the longitudinal axis of the air piston; wherein when a first port of a directional control valve supplies compressed air to a pilot of the first flow control valve, the first control valve supplies air to a first side of the air cylinder via a first air cylinder port, thereby moving the air piston toward a second side of the air cylinder; wherein as the air piston moves to the second side of the air cylinder, air present in the second side of the air cylinder is exhausted through a second air cylinder port and through the second flow control valve to atmosphere; wherein movement of the air piston toward the second side of the air cylinder causes the first hydraulic ram to move toward the second side of the air cylinder, thereby pressurizing hydraulic fluid within the first hydraulic cylinder and forcing pressurized hydraulic fluid within the first hydraulic cylinder to exit the first hydraulic cylinder through a first hydraulic check valve and through a first external hydraulic line into external lift cylinders; wherein movement of the air piston toward the second side of the air cylinder causes the second hydraulic ram to move toward the second side of the air cylinder, thereby drawing hydraulic fluid into the second hydraulic cylinder from a hydraulic reservoir through a second external hydraulic line and through a second hydraulic check valve; wherein the air piston continues to move toward the second side of the air cylinder until it contacts a first plunger-operated pilot valve; and wherein the first plunger-operated pilot valve is an end-of-stroke sensor for the air piston.

In a preferred embodiment, when the air piston comes into contact with the first plunger-operated pilot valve, the first plunger-operated pilot valve supplies compressed air to a first pneumatic pilot tube; the first pneumatic pilot tube is connected to a first pilot of the directional control valve; air pressure on the first pilot of the directional control valve causes the directional control valve to shuttle, thereby causing compressed air to be supplied from a second port of the directional control valve to a second pneumatic pilot tube that is connected to a pilot of the second flow control valve and causing compressed air to flow into the second side of the air cylinder through a first air supply pipe, through the second flow control valve, and through the second air cylinder port; the compressed air moving into the second side of the air cylinder causes the air piston to stop moving toward the second side of the air cylinder and to begin moving toward the first side of the air cylinder; as output of the compressed air shifts from the first port of the directional flow control valve to the second port of the directional control valve, air pressure is removed from the pilot of the first flow control valve, thereby causing internal components within the first flow control valve to shift an internal air flow path within the first flow control valve to a deactivated state; and the shifting of the internal air flow path within the first flow control valve to a deactivated state allows compressed air in the first side of the air cylinder to exit the air cylinder through the first cylinder port and escape to atmosphere through an exhaust port of the first flow control valve.

In a preferred embodiment, as compressed air enters the second side of the air cylinder, the air piston moves toward the first side of the air cylinder and away from the second side of the air cylinder; compressed air flows through second port of the directional control valve to the pilot of the second flow control valve, thereby causing the second control valve to supply compressed air to the second side of the air cylinder via the second air cylinder port; as the air piston moves toward the first side of the air cylinder, air that is in the first side of the air cylinder is exhausted to atmosphere through the first flow control valve via the first air cylinder port; movement of the air piston toward the first side of the air cylinder causes the second hydraulic ram to move toward the first side of the air cylinder, thereby pressurizing hydraulic fluid within the second hydraulic cylinder and forcing the pressurized hydraulic fluid to exit the second hydraulic cylinder through a third hydraulic check valve, through a third external hydraulic line, and into the external lift cylinders; and movement of the air piston toward the first side of the air cylinder causes the first hydraulic ram to move toward the first side of the first hydraulic cylinder, thereby drawing hydraulic fluid into the first hydraulic cylinder from the hydraulic reservoir via a fourth external hydraulic line and through a fourth hydraulic check valve.

In a preferred embodiment, movement of the air piston toward the first side of the air cylinder causes it to contact a second plunger-operated pilot valve, thereby causing the second plunger-activated pilot valve to supply compressed air to a third pneumatic pilot tube that is connected to a second pilot of the directional control valve; air pressure on the second pilot of the directional control valve causes the directional control valve to shuttle, thereby causing compressed air to be supplied from the first port of the directional control valve to a fourth pneumatic pilot tube that is connected to a pilot of the first flow control valve and causing compressed air to flow into the first side of the air cylinder through a second air supply pipe, through the first flow control valve, and through the first air cylinder port; the compressed air moving into the first side of the air cylinder causes the air piston to stop moving toward the first side of the air cylinder and begin moving toward the second side of the air cylinder; as output of the compressed air shifts from the second port of the directional flow control valve to the first port of the directional control valve, air pressure is removed from the pilot of the second flow control valve, thereby causing the second flow control valve to shift to a deactivated state; and the shifting of the second flow control valve to a deactivated state allows compressed air in the second side of the air cylinder to exit the air cylinder via the second air cylinder port and escape to atmosphere through an exhaust port of the second flow control valve.

In a preferred embodiment, the invention further comprises a first seal keeper and a second seal keeper, wherein the first seal keeper maintains a fluid-tight pressure seal between the air cylinder and the first and second hydraulic cylinders, and the second seal keeper maintains a fluid-tight pressure seal between the air cylinder and the first and second hydraulic rams. Preferably, both of the first and second seal keepers are in the form of a cylinder with a hollow core.

In a preferred embodiment, the invention further comprises a first end block that attaches the air cylinder to the first hydraulic cylinder and a second end block that attaches the air cylinder to the second hydraulic cylinder; wherein the first plunger-operated pilot valve is installed into the first end block, and the second plunger-operated pilot valve is installed into the second end block. Preferably, the first hydraulic check valve and the fourth hydraulic check valve are attached to a distal end of the first hydraulic cylinder with a first dual-port threaded valve fitting so that the first hydraulic check valve is connected parallel to a radial axis of the first hydraulic cylinder and the fourth hydraulic check valve is connected parallel to a longitudinal axis of the first hydraulic cylinder. The second hydraulic check valve and the third hydraulic check valve are preferably connected to a distal end of the second hydraulic cylinder with a second dual-port valve fitting so that the second hydraulic check valve is connected parallel to a longitudinal axis of the second hydraulic cylinder and the third hydraulic check valve is connected parallel to a radial axis of the second hydraulic cylinder.

In a preferred embodiment, an outlet of the first plunger-operated pilot valve is connected to a first pilot of the directional control valve by the first pneumatic pilot tube, and wherein an outlet of the second plunger-operated pilot valve is connected to a second pilot of the directional control valve by the third pneumatic pilot tube; and the second port of the directional control valve is connected to the second flow control valve with the third pneumatic pilot tube, and the first port of the directional control valve is connected to the first flow control valve with the fourth pneumatic pilot tube. Preferably, the invention further comprises a first drip leg and a second drip leg, both of which are mounted on a bottom side of the air cylinder, and both of which are moisture drain valves to drain fluids that accumulate on a bottom inside surface of the air cylinder. Each of the first and second hydraulic rams preferably has an outer diameter, and the outer diameters of the first and second hydraulic rams are selected to provide a certain value of pressure amplification.

In a preferred embodiment, the first plunger-operated pilot valve comprise an inlet port, an outlet port, a plunger, a barrel, and a compression spring with a force; the plunger comprises a push rod and an annular flow channel; the barrel has four flow channels; the first plunger-operated pilot valve is activated when the push rod of the plunger is contacted by the air piston, thereby causing the plunger to overcome the force of the compression spring and to move; and movement of the plunger causes the flow channel of the plunger to connect to the four flow channels of the barrel, thereby allowing compressed air to enter the inlet port, pass through the flow channels of the plunger and the barrel, and exit through the outlet port. Preferably, the second plunger-operated pilot valve comprises an inlet port, an outlet port, a plunger, a barrel, and a compression spring with a force; wherein the plunger comprises a push rod and an annular flow channel; wherein the barrel has four flow channels; wherein the second plunger-operated pilot valve is activated when the push rod of the plunger is contacted by the air piston, thereby causing the plunger to overcome the force of the compression spring and to move; and wherein movement of the plunger causes the flow channel of the plunger to connect to the four flow channels of the barrel, thereby allowing compressed air to enter the inlet port, pass through the flow channels of the plunger and the barrel, and exit through the outlet port.

REFERENCE NUMBERS

Figure 1:
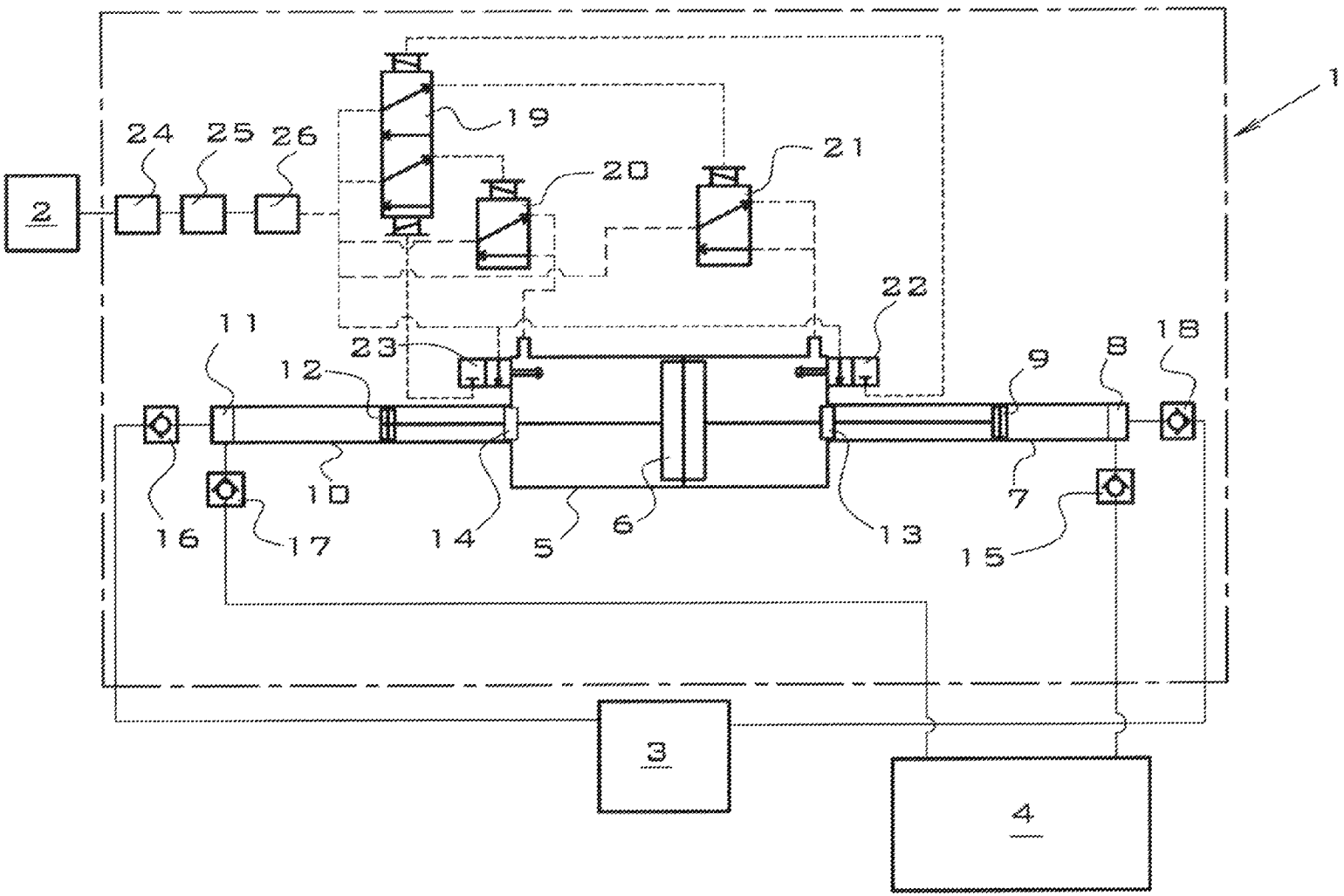
FIG. 1 is a schematic depiction of the present invention showing the major pneumatic and hydraulic components.

1 Present invention, hydraulic pressure amplifier (schematic view)
2 Air supply (schematic view)
3 Hydraulic fluid reservoir (schematic view)
4 Lift cylinders (schematic view)
5 Air cylinder (schematic view)
6 Air piston (schematic view)
7 First hydraulic cylinder (schematic view)
8 First valve fitting (schematic view)
9 First hydraulic ram (schematic view)
10 Second hydraulic cylinder (schematic view)
11 Second valve fitting (schematic view)
12 Second hydraulic ram (schematic view)
13 First seal keeper (schematic view)
14 Second seal keeper (schematic view)
15 First hydraulic check valve (schematic view)
16 Second hydraulic check valve (schematic view)
17 Third hydraulic check valve (schematic view)
18 Fourth hydraulic check valve (schematic view)
19 Directional control valve (schematic view)
20 First flow control valve (schematic view)
21 Second flow control valve (schematic view)
22 First plunger-operated pilot valve (schematic view)
23 Second plunger-operated pilot valve (schematic view)
24 Bulk water separator (schematic view)
25 Particulate filter (schematic view)
26 Combination filter-regulator-lubricator, FRL (schematic view)
27 Compressed air (schematic view)
28 First air cylinder port (schematic view)
29 Second air cylinder port (schematic view)
30 Hydraulic fluid (schematic view)
31 First hydraulic line (schematic view)
32 Second hydraulic line (schematic view)
33 First pneumatic pilot tube (schematic view)
34 First pilot of the directional control valve (schematic view)
35 Second pneumatic pilot tube (schematic view)
36 First air supply pipe (schematic view)
37 Third hydraulic line (schematic view)
38 Fourth hydraulic line (schematic view)
39 Third pneumatic pilot tube (schematic view)
40 Second pilot of the directional control valve (schematic view)
41 Fourth pneumatic pilot tube (schematic view)
42 Second air supply pipe (schematic view)
43 Air cylinder
44 First hydraulic cylinder
45 Second hydraulic cylinder
46 First hydraulic check valve
47 Second hydraulic check valve
48 Third hydraulic check valve
49 Fourth hydraulic check valve
50 Directional control valve
51 First flow control valve
52 Second flow control valve
53 First plunger-operated pilot valve
54 Second plunger-operated pilot valve
55 Bulk water separator
56 Particulate filter
57 FRL (filter-regulator-lubricator)
58 First pneumatic pilot tube
59 Second pneumatic pilot tube
60 Third pneumatic pilot tube
61 Fourth pneumatic pilot tube
62 First air supply pipe
63 Second air supply pipe
64 First end block
65 Second end block
66 Threaded rod assembly
67 Support bracket
68 First threaded connector
69 Second threaded connector
70 Exhaust muffler
71 First dual-port valve fitting
72 Second dual-port valve fitting
73 First drip leg
74 Second drip leg
75 First hydraulic ram
76 Second hydraulic ram
77 Air piston
78 First seal keeper
79 Second seal keeper
80 First air cylinder port
81 Second air cylinder port
82 U-seal, air piston

83 Wear band
84*a* U-seal, pneumatic, seal keeper
84*b* U-seal, hydraulic, seal keeper
85 O-ring seal keeper
86 Fifth pneumatic pilot line
87 Sixth pneumatic pilot line
88 Inlet port, plunger-operated pneumatic valve
89 Outlet port, plunger-operated pneumatic valve
90 Plunger
91 Barrel
92 Compression spring
93 Push rod
94 Flow channel, plunger
95 First O-ring, plunger
96 Second O-ring, plunger
97 Flow channel, barrel
98 O-ring, barrel

DETAILED DESCRIPTION OF INVENTION

Air-to-hydraulic pressure amplifiers are devices that utilize an input flow of compressed air to produce an output flow of pressurized hydraulic fluid, wherein the pressurized hydraulic fluid is typically used to operate high-capacity hydraulic lift devices such as railroad car side-dump beds, automobile lifts, etc. Air-to-hydraulic pressure amplifiers utilize an input flow of compressed air at a particular volumetric flowrate and a particular pressure to produce an output flow of hydraulic fluid, wherein the pressure of the hydraulic fluid is greater than the pressure of the air, but the flowrate of the hydraulic fluid is less than the flowrate of the air. The ratio of the pressures and flowrates is a function of the cross-sectional surface areas of the air piston and the hydraulic rams of the devices. The pressure amplification ratio may be expressed as follows:

$$\text{Pressure Ratio}=(d_{ap}^2-d_{hr}^2)/d_{hr}^2$$

where Pressure Ratio is the ratio of hydraulic fluid pressure to air pressure, $d_{ap}$ is the outside diameter of the air piston, and $d_{hr}$ is the outside diameter of the hydraulic ram. The flow volume ratio is the inverse of the pressure ratio. For example, if the hydraulic fluid pressure is greater than the air pressure by a factor of 30, the hydraulic fluid flowrate will be 1/30 of the air flowrate. Details of the major components and operation of the present invention are described in reference to FIG. 1 through 15.

FIGS. 1 through 5 are schematic representations of the present invention, with air pilot tubings shown as short-dashed lines, air supply pipes shown as long-dashed lines, and hydraulic fluid tubings shown as solid lines. FIG. 1 is a schematic depiction of the major pneumatic and hydraulic components of the present invention 1, shown with the present invention 1 being used in combination with an external air supply 2, an external hydraulic fluid reservoir 3, and external lift cylinders 4. The present invention comprises an air cylinder 5 with an internal reciprocating air piston 6, a first hydraulic cylinder 7 with a first valve fitting 8 and an internal first hydraulic ram 9, a second hydraulic cylinder 10 with a second valve fitting 11 and an internal second hydraulic ram 12, a first seal keeper 13, a second seal keeper 14, a first hydraulic check valve 15, a second hydraulic check valve 16, a third hydraulic check valve 17, a fourth hydraulic check valve 18, a directional control valve 19, a first flow control valve 20, a second flow control valve 21, a first plunger-operated pilot valve 22, a second plunger-operated pilot valve 23, a bulk water separator 24, a particulate filter 25, and a combination filter-regulator-lubricator ("FRL") 26. The present invention is designed to operate using an external supply of compressed air in the range of approximately 70 to 120 pounds per square inch (psi), such as is typically available on railroad cars.

Figure 2:
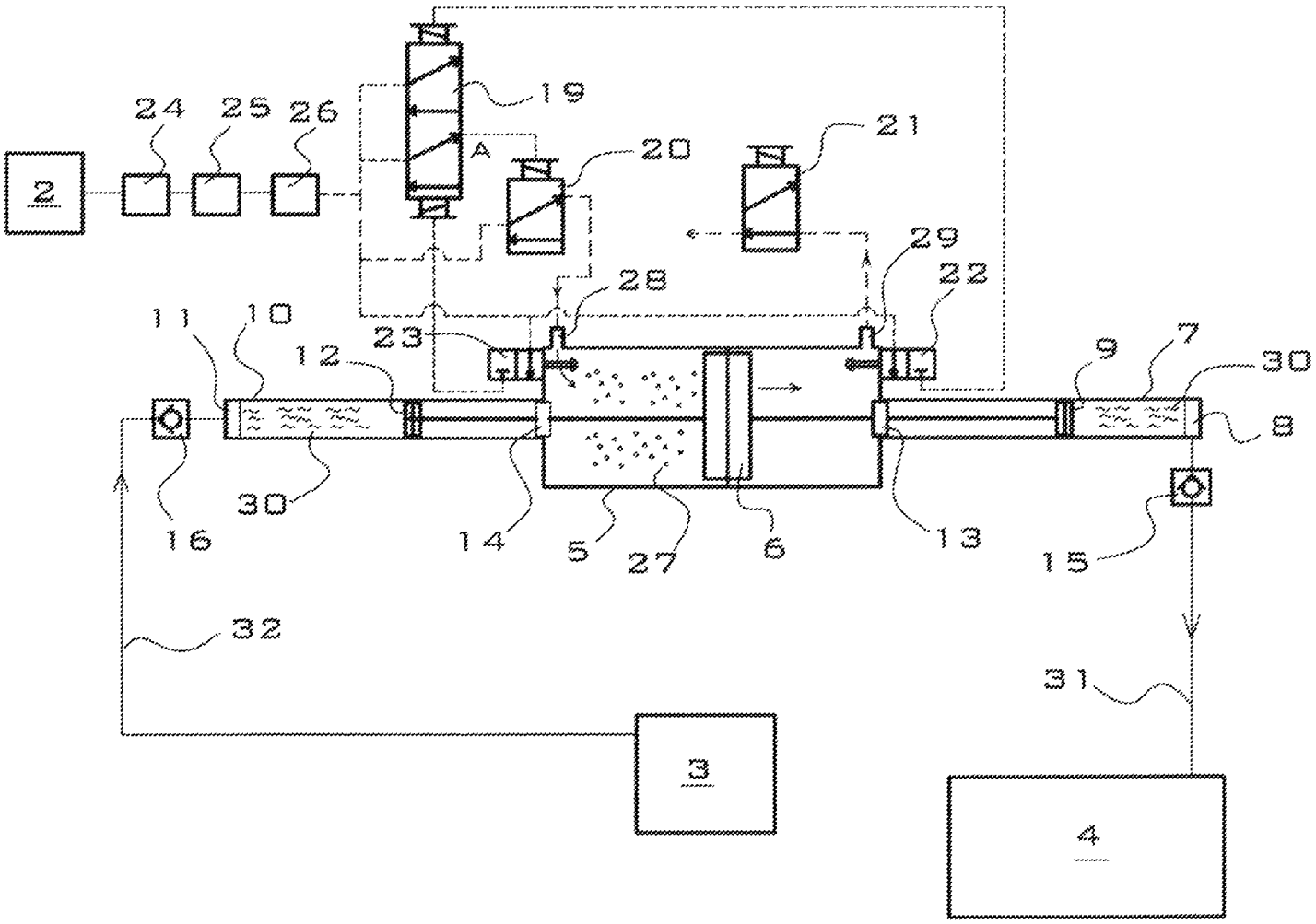
FIG. 2 is a schematic depiction of the present invention at a time $t_1$ with the air piston moving from left to right within the air cylinder.

FIGS. 2 through 5 are schematic depictions that illustrate the operation of the present invention as the air piston moves from right to left and then from left to right during one operating cycle. FIG. 2 illustrates the present invention at a time $t_1$. At this time, the air piston 6 is being pushed from left to right (as shown by the solid straight arrow) within the air cylinder 5 as a result of compressed air 27 entering the left side of the air cylinder 5. This compressed air flows from the external air supply 2, then through the bulk water separator 24, the particulate filter 25, the FRL 26, and through port A of the directional control valve 19 to the pilot of the first flow control valve 20. When air pressure is applied to the pilot of the first control valve 20, the first control valve 20 supplies compressed air to the left side of the air cylinder 5 via a first air cylinder port 28, as shown by the curved arrow. As the air piston 6 moves to the right, air that is present in the right side of the air cylinder 5 is exhausted via a second air cylinder port 29 and then through the second flow control valve 21 to the atmosphere. The movement of the air piston 6 to the right causes the attached first hydraulic ram 9 to also move to the right, which pressurizes hydraulic fluid 30 within the first hydraulic cylinder 7 and forces the pressurized hydraulic fluid 30 to exit the first hydraulic cylinder 7 through the first hydraulic check valve 15 and then through an external first hydraulic line 31 into the external lift cylinders 4. The movement of the air piston 6 to the right also causes the attached second hydraulic ram 12 to move to the right, which draws hydraulic fluid 30 into the second hydraulic cylinder 10 from the hydraulic reservoir 3 via a second external hydraulic line 32 and then through the second hydraulic check valve 16. The first seal keeper 13 and the second seal keeper 14 maintain fluid-tight pressure seals between the air cylinder 5 and the first and second hydraulic cylinders 7 and 10 and also between the air cylinder 5 and the first and second hydraulic rams 8 and 12. The air piston 6 continues to move to the right until it contacts the first plunger-operated pilot valve 22, which serves as an end-of-stoke sensor for the air piston 6.

Figure 3:
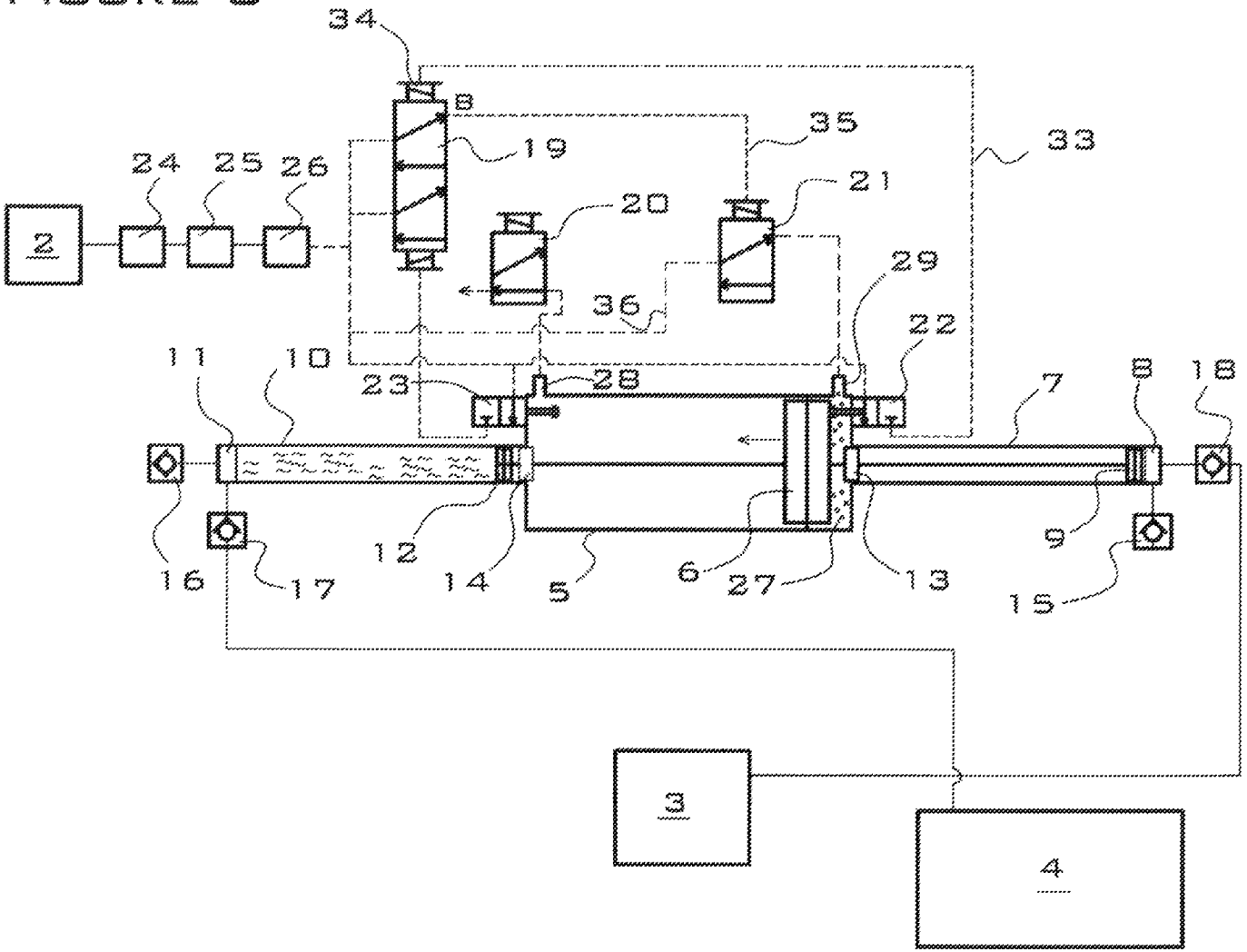
FIG. 3 is a schematic depiction of the present invention at a time $t_2$ when the air piston has traveled to the right sufficiently to contact the first plunger-activated pilot valve.

FIG. 3 illustrates the operation of the components of the present invention at a time $t_2$ when the air piston 6 has traveled to the right sufficiently to contact the first plunger-activated pilot valve 22, thereby causing the first plunger-activated pilot valve 22 to supply compressed air to a first pneumatic pilot tube 33, which is connected to a first pilot 34 of the directional control valve 19. This air pressure on the first pilot 34 of the directional control valve 19 causes the directional control valve 19 to shuttle so that compressed air is supplied from port B of the directional control valve 19 to a second pneumatic pilot tube 35, which is connected to the pilot of the second flow control valve 21, thereby causing compressed air 27 to flow into the right side of the air cylinder 5 through a first air supply pipe 36, then through the second flow control valve 21, and then through the second air cylinder port 29. The compressed air 27 moving into the right side of the air cylinder 5 causes the air piston 6 to stop moving to the right and begin moving to the left, as shown by the straight arrow. When the output port of compressed air from the directional flow control valve 19 shifts from port A to port B, air pressure is removed from the pilot of the first flow control valve 20, thereby causing the control valve 20 to shift to the deactivated (or "valve off") state, which allows compressed air in the left side of the air cylinder 5 to exit the air cylinder 5 via the first air cylinder port 28 and escape to the atmosphere through the exhaust port of the first flow control valve 20.

Figure 4:
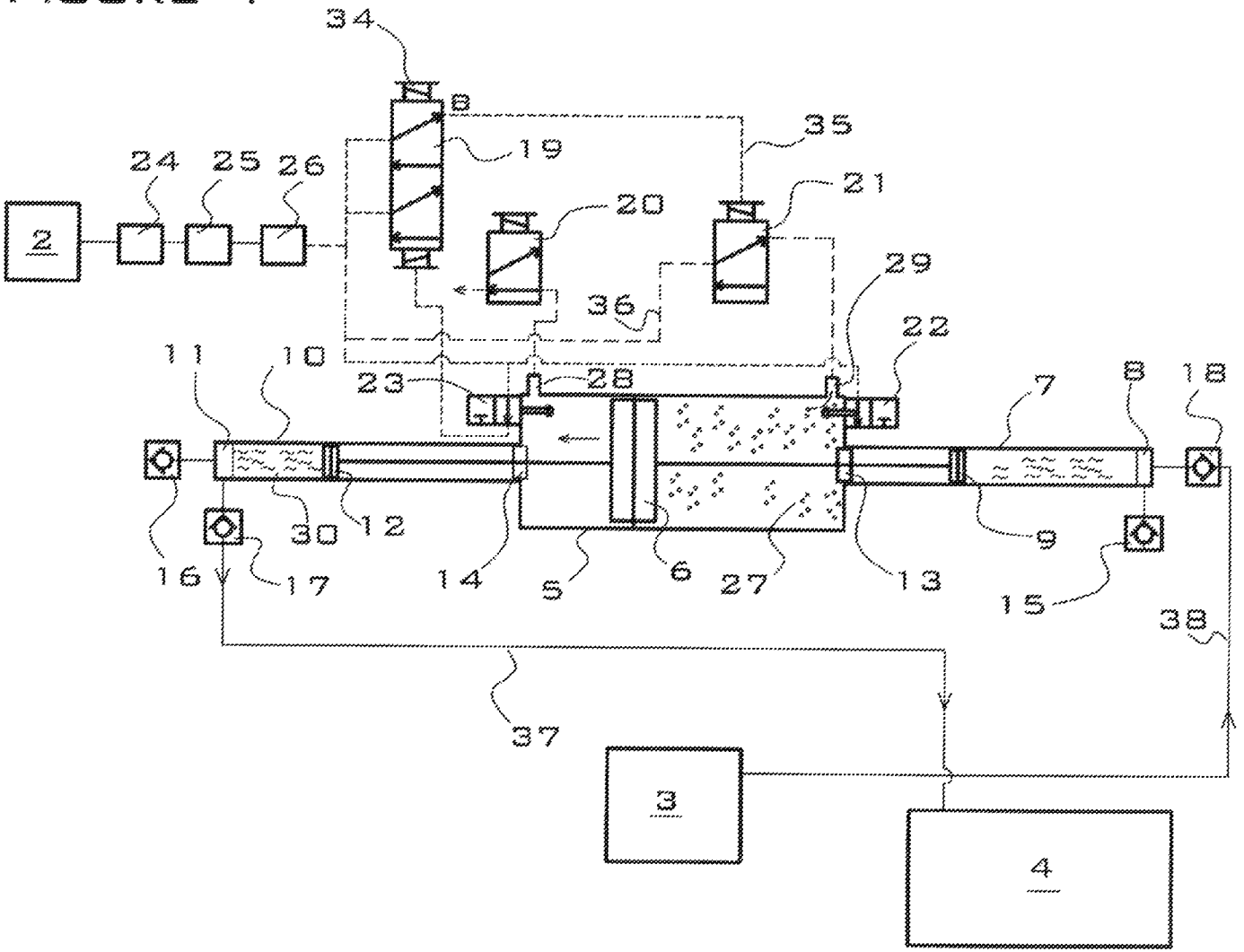
FIG. 4 is a schematic depiction of the present invention at a time $t_3$ with the air piston moving from right to left within the air cylinder.

FIG. 4 illustrates the operation of the components of the present invention at a time $t_3$ when the air piston 6 is moving to the left within the air cylinder 5. At this time, the air piston 6 is being pushed from right to left (as shown by the solid straight arrow) within the air cylinder 5 as a result of compressed air 27 entering the right side of the air cylinder 5. This compressed air flows from the air supply 2, then through the bulk water separator 24, the particulate filter 25, the FRL 26, and through port B of the directional control valve 19 to the pilot of the second flow control valve 21. When air pressure is applied to the pilot of the first control valve 21, the first control valve 21 supplies compressed air to the right side of the air cylinder 5 via the second air cylinder port 29, as shown by the curved arrow. As the air piston 6 moves to the left, air that is present in the left side of the air cylinder 5 is exhausted to the atmosphere through the first flow control valve 20 via a first air cylinder port 28. The movement of the air piston 6 to the left causes the attached second hydraulic ram 12 to also move to the left, which pressurizes hydraulic fluid 30 within the second hydraulic cylinder 10 and forces the pressurized hydraulic fluid 30 to exit the second hydraulic cylinder 10 through the third hydraulic check valve 17 and then through an external third hydraulic line 37 into the external lift cylinders 4. The movement of the air piston 6 to the left also causes the attached first hydraulic ram 9 to move to the left, which draws hydraulic fluid 30 into the first hydraulic cylinder 7 from the hydraulic reservoir 3 via an external fourth hydraulic line 38 and then through the fourth hydraulic check valve 18.

Figure 5:
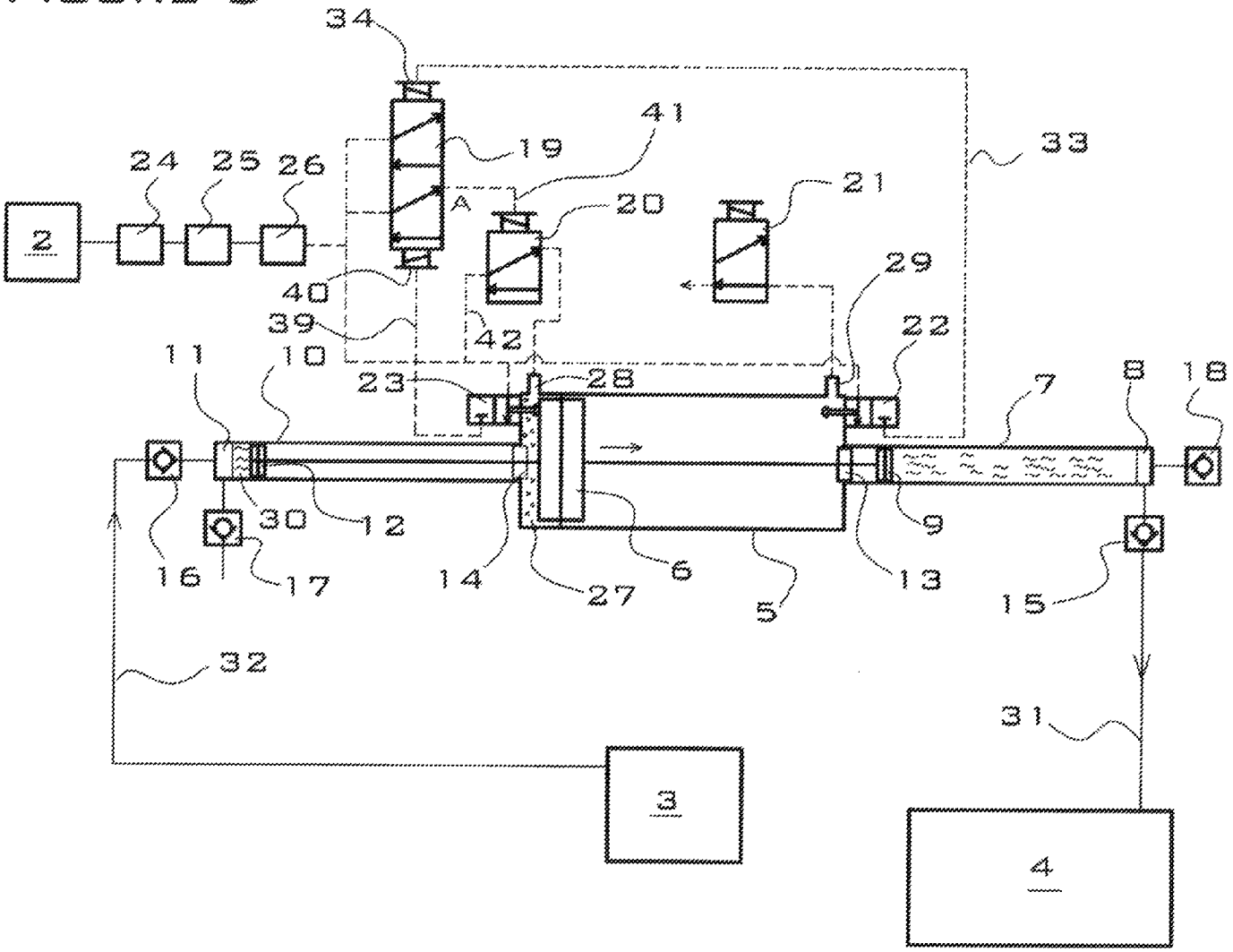
FIG. 5 is a schematic depiction of the present invention at a time $t_4$ when the air piston has traveled to the left sufficiently to contact the second plunger-activated pilot valve.

FIG. 5 illustrates the operation of the components of the present invention at a time to when the air piston 6 has traveled to the left sufficiently to contact the second plunger-activated pilot valve 23, thereby causing the second plunger-activated pilot valve 23 to supply compressed air to a third pneumatic pilot tube 39, which is connected to a second pilot 40 of the directional control valve 19. This air pressure on the second pilot 40 of the directional control valve 19 causes the directional control valve 19 to shuttle so that compressed air is supplied from port A of the directional control valve 19 to a fourth pneumatic pilot tube 41, which is connected to the pilot of the first flow control valve 20, thereby causing compressed air 27 to flow into the left side of the air cylinder 5 through a second air supply pipe 42, then through the first flow control valve 20, and then through the first air cylinder port 28. The compressed air 27 moving into the left side of the air cylinder 5 causes the air piston 6 to stop moving to the left and begin moving to the right, as shown by the straight arrow. When the output port of compressed air from the directional flow control valve 19 shifts from port B to port A, air pressure is removed from the pilot of the second flow control valve 21, thereby causing internal components within the second flow control valve 21 to mechanically shift the internal air flow path within the second flow control valve 21 to the deactivated (or "valve off") state, which allows compressed air in the right side of the air cylinder 5 to exit the air cylinder 5 via the second air cylinder port 29 and then escape to the atmosphere through the exhaust port of the second flow control valve 21.

As shown in FIGS. 2 through 5, the flow of pressurized hydraulic fluid into the lift cylinders 4 is substantially constant when the air piston 6 is moving in either direction.

Figure 6:
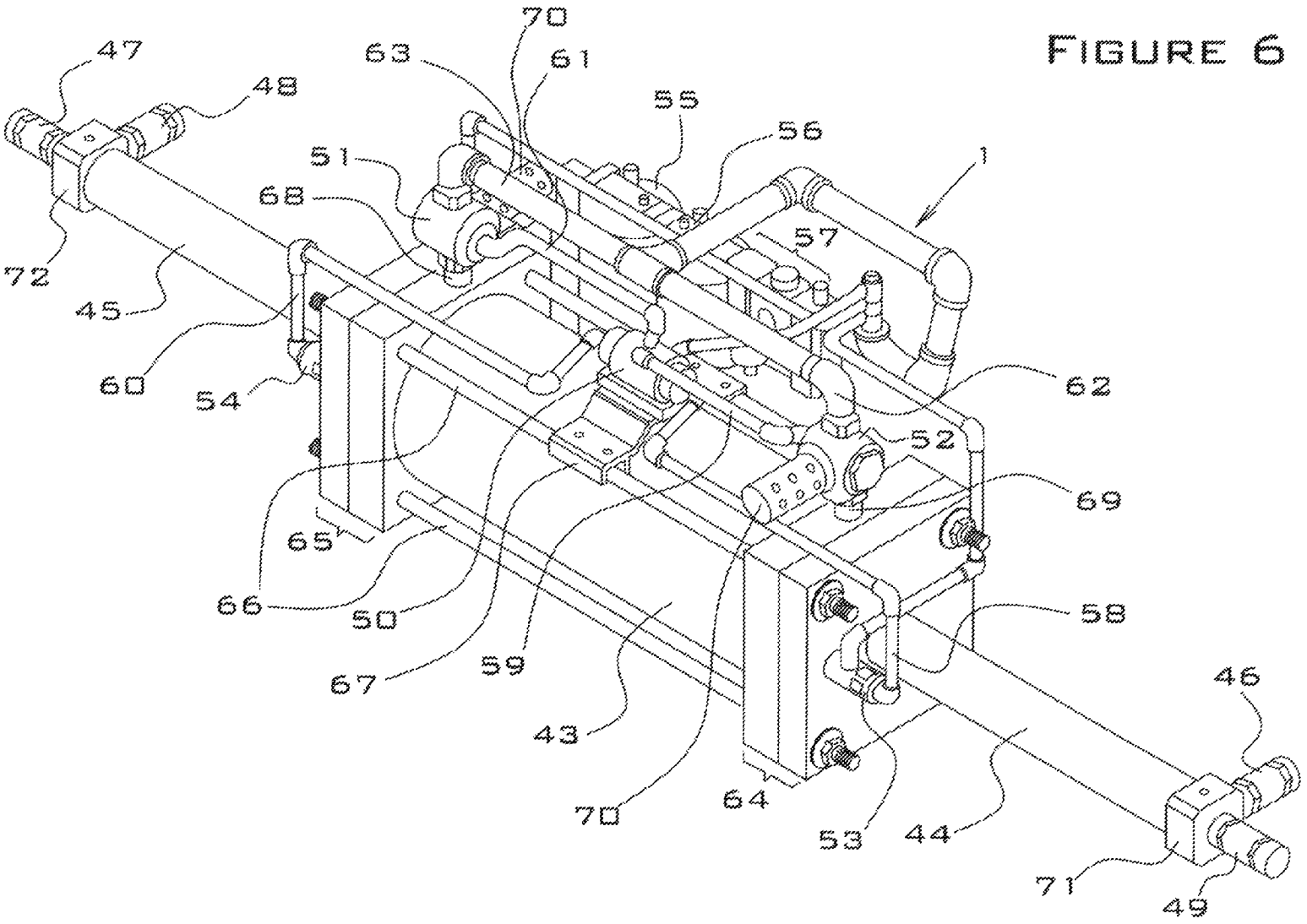
FIG. 6 is an isometric view of the present invention showing the front, right and top sides.

FIG. 6 is an isometric view of the present invention showing the front, right and top sides. Major components shown in FIG. 6 include the air cylinder 43, the first hydraulic cylinder 44, the second hydraulic cylinder 45, the first hydraulic check valve 46, the second hydraulic check valve 47, the third hydraulic check valve 48, the fourth hydraulic check valve 49, the directional control valve 50, the first flow control valve 51, the second flow control valve 52, the first plunger-operated pilot valve 53, the second plunger-operated pilot valve 54, the bulk water separator 55, the particulate filter 56, the FRL 57, the first pneumatic pilot tube 58, the second pneumatic pilot tube 59, the third pneumatic pilot tube 60, the fourth pneumatic pilot tube 61, the first air supply pipe 62, and the second air supply pipe 63. A first end block 64 and a second end block 65 are used to attach the air cylinder 43 to the first hydraulic cylinder 44 and the second hydraulic cylinder 45, respectively. The two end blocks 64, 65 are connected together with four threaded rod assemblies 66. The first plunger-operated pilot valve 53 is installed into the first end block 64, and the second plunger-operated pilot valve 54 is installed into the second end block 65 via threaded holes that are machined into each end block 64, 65. The directional control valve 50 is mounted to a support bracket 67 that is attached to two of the threaded rod assemblies 66. The first flow control valve 51 is pneumatically and mechanically connected to the left side of the air cylinder 43 via a first threaded connector 68 that is screwed into the top of the second end block 65. The second flow control valve 52 is pneumatically and mechanically connected to the right side of the air cylinder 43 via a second threaded connector 69 that is screwed into the top of the first end block 64. The first and second flow control valves 5, 52 are equipped with exhaust mufflers 70 to reduce noise and decrease the velocity of released gasses.

The first hydraulic check valve 46 and the fourth hydraulic check valve 49 are attached to the distal end of the first hydraulic cylinder 44 via a first dual-port threaded valve fitting 71, so that the first hydraulic check valve 46 is connected parallel to the radial axis of the first hydraulic cylinder 44 and the fourth hydraulic check valve 49 is connected parallel to the longitudinal axis of the first hydraulic cylinder 44. This configuration minimizes the fluid head loss of the hydraulic fluid as it is being sucked through the fourth hydraulic check valve 49 into the hydraulic cylinder 44, and thereby eliminates cavitation that would otherwise occur due to excessively low pressure in the hydraulic cylinder 44. This feature eliminates the requirement for pressurizing the external hydraulic fluid reservoir, and is therefore an advantage over examples of prior art that require a pressurized reservoir.

Because hydraulic fluid is forced out of the first hydraulic cylinder 44 through the first hydraulic check valve 46 under positive pressure, cavitation is not a problem for this valve. The second hydraulic check valve 47 and the third hydraulic check valve 48 are connected to the distal end of the second hydraulic cylinder 45 with a second dual-port valve fitting 72 in a similar configuration to that of the first hydraulic cylinder 44, wherein the third hydraulic check valve 46 is connected parallel to the radial axis of the first hydraulic cylinder 44 and the second hydraulic check valve 49 is connected parallel to the longitudinal axis of the second hydraulic cylinder 45, thereby preventing cavitation problems when hydraulic fluid is sucked into the second hydraulic cylinder 45 through the second hydraulic check valve 47.

The inlet connection of the bulk water separator 55 is attached to the inlet air supply (not shown) with an air-tight threaded connection (not shown). The bulk water separator 55, the particulate filter 56, and the FRL 57 are connected in series with air-tight threaded connections, and the outlet of the FRL 57 is connected to the first air supply pipe 62 and the second air supply pipe 63 with air-tight threaded connections. The outlet of the first plunger-operated pilot valve 53 is connected to one pilot shown as reference number 34 in FIG. 3) of the directional control valve 50 with the first pneumatic pilot tube 58, and the outlet of the second plunger-operated pilot valve 54 is connected to one pilot (shown as reference number 40 in FIG. 5) of the directional control valve 50 with the third pneumatic pilot tube 60. One outlet (shown as port A in FIG. 5) of the directional control valve 50 is connected to the first flow control valve 51 with the fourth pneumatic pilot tube 61, and one outlet (shown as port B in FIG. 4) of the directional control valve 50 is connected to the second flow control valve 52 with the second pneumatic pilot tube 59.

In a preferred embodiment of the present invention, several of the components are commercially available parts. For example, a Parker WSA-FMO separator may be used as the bulk water separator 55, a Parker filter F30-08-FOO may be used as the particulate filter 56, a Rexroth R4320002719 may be used as the FRL unit, Ross BP-1/16-18-PNE-Type 1 valves may be used as the first and second flow control valves 51, 52 and may be fitted with Ross 5500A6003 exhaust mufflers. A Ross 1968B6017 valve may be used as the directional control valve 50, and Anchor CN 1-1/4-1-7 valves may be used as the first through fourth hydraulic check valves 46 through 49. Three-eighth inch outside diameter flexible tubing with push-to-connect fittings may be used for the first through fourth pneumatic pilot tubes 58, 59, 60 and 61. The first and second plunger-operated pilot valves 53, 54 are novel, custom-made components that are described in detail in reference to FIGS. 12 through 14.

Figure 7:
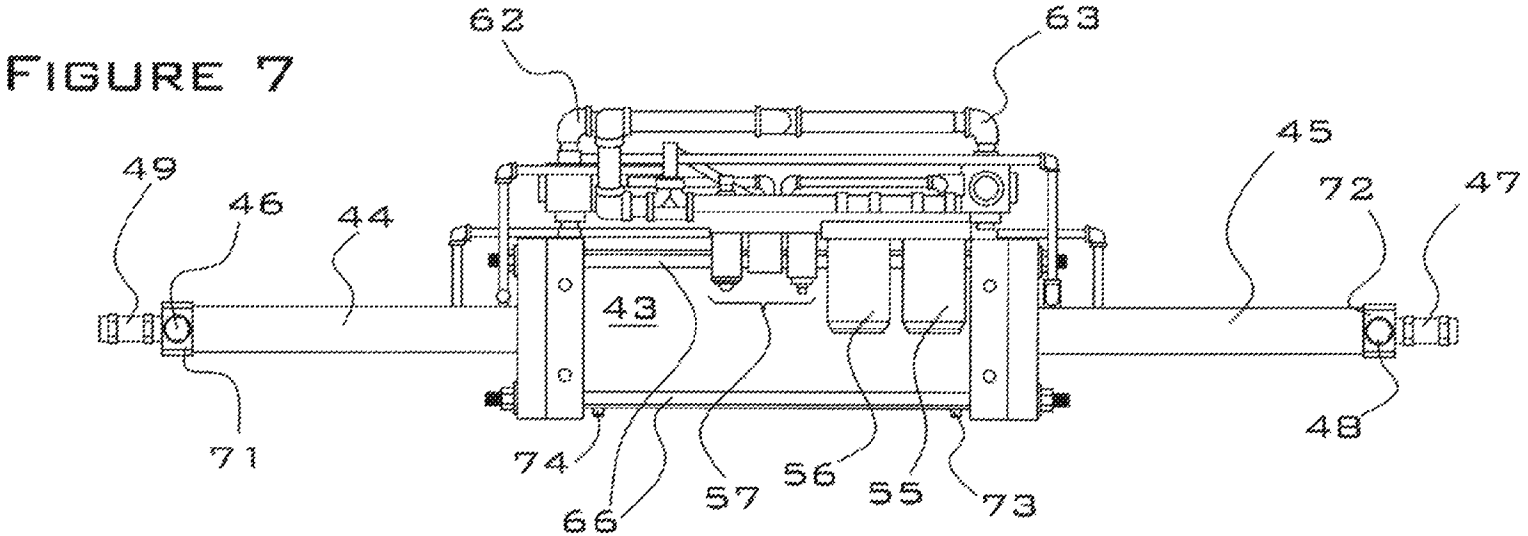
FIG. 7 is a rear elevation view of the present invention.

FIG. 7 is a rear elevation view of the present invention that shows a first drip leg 73 and a second drip leg 74, both mounted on the bottom outside surface of the air cylinder 43, with the first drip leg 73 positioned about 1.5 inch to the left of the right edge of the air cylinder 43 and the second drip leg 74 positioned about 1.5 inch to the right of the left edge of the air cylinder 43. The drip legs 73, 74 serve as moisture drain valves to drain condensed water and other fluids that may accumulate on the bottom inside surface of the air cylinder 43. Each drip leg comprises a port that connects the inside of the air cylinder to the atmosphere and a ball float that seals the drip leg port when the drip leg is dry but floats upward to open the port when water enters the drip leg, thereby automatically draining water through the drip leg to the atmosphere. In a preferred embodiment, the drip legs 73, 74 are identical commercially available parts. One example of a suitable part is drip leg part number 41645K47 available from McMaster-Carr Supply Company of Santa Fe Springs, Calif. Other major components of the present invention shown in FIG. 7 include the first hydraulic cylinder 44, the second hydraulic cylinder 45, the bulk water separator 55, the particulate filter 56, the FRL unit 57, two of the threaded rod assemblies 66, the first through fourth hydraulic check valves 46 through 49, the first air supply pipe 62 and the second air supply pipe 63.

Figure 8:
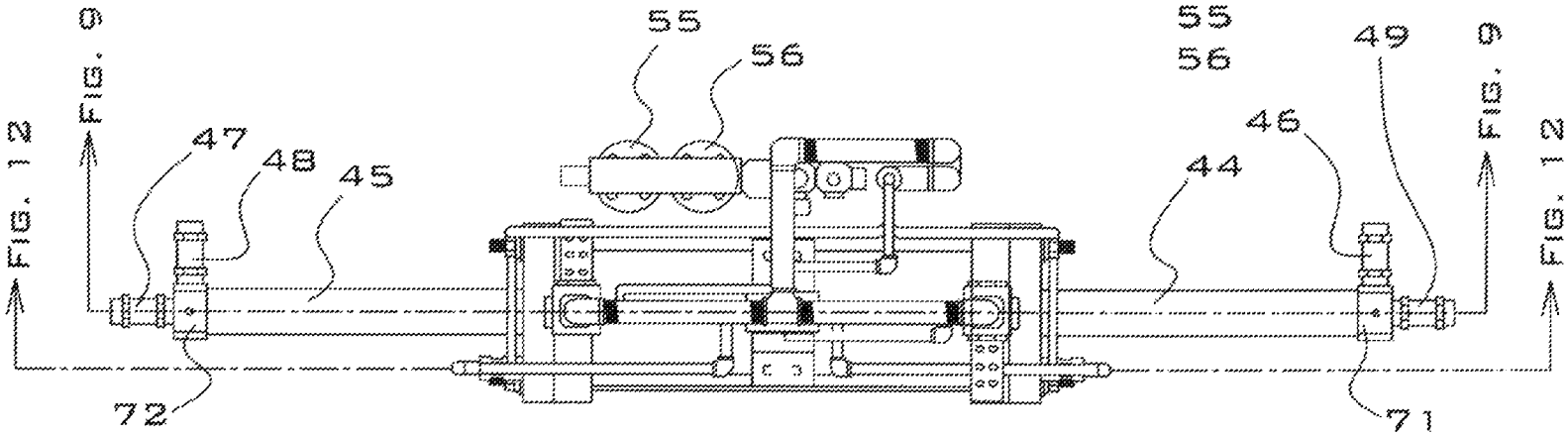
FIG. 8 is a plan view of the present invention.
Figure 9:
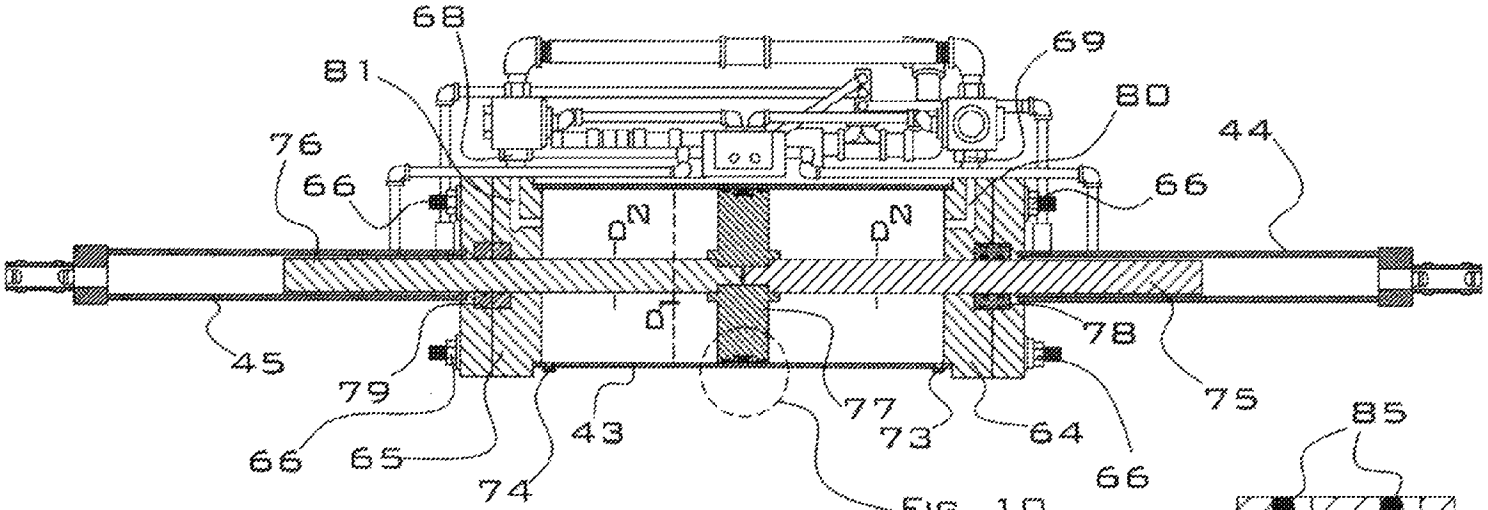
FIG. 9 is a cross-section longitudinal view of the pneumatic and hydraulic cylinders of the present invention taken at the center line of the pneumatic and hydraulic cylinders.
Figure 12:
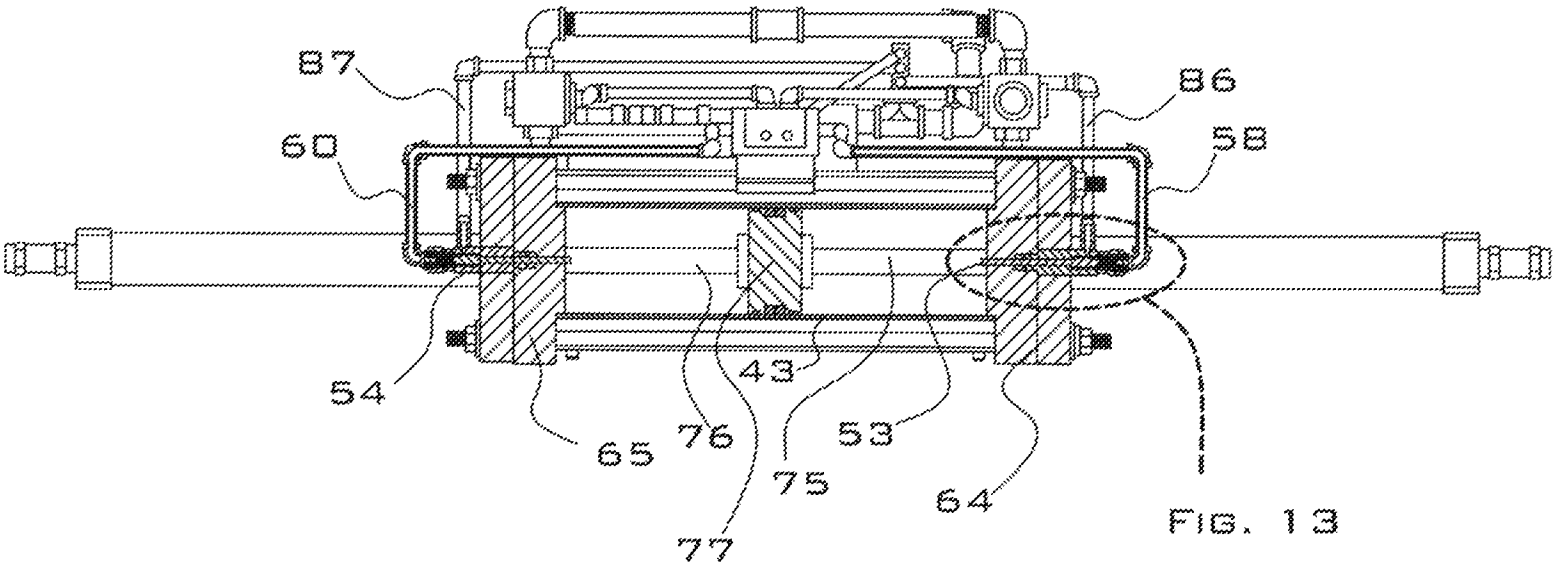
FIG. 12 is a cross-section longitudinal view of the air cylinder and plunger-operated pilot valves of the present invention taken at the center line of the plunger-operated pilot valves.

FIG. 8 is a top view of the present invention, with section lines drawn for the cross sections shown in FIGS. 9 and 12. Major components shown in FIG. 8 include the first hydraulic cylinder 44, the second hydraulic cylinder 45, the bulk water separator 55, the particulate filter 56, the first through fourth hydraulic check valves 46 through 49, and the first and second dual port valve fittings 71, 72.

FIG. 9 is a cross-section view of the air cylinder 43 and the first and second hydraulic cylinders 44, 45 of the present invention, with the section line taken through the center of the longitudinal axes of the three collinear air and hydraulic cylinders 43, 44 and 45. For clarity, components of the present invention other than the air and hydraulic cylinders 43, 44, 45 and their internal components are not shown in cross section in this drawing. As shown, a first cylindrical-shaped hydraulic ram 75 is slidably positioned within the first hydraulic cylinder 44, and an identical second hydraulic ram 76 is slidably positioned within the second hydraulic cylinder 45. The outside diameters of the first and second hydraulic rams 75, 76 are the same, and these outside diameters are selected so as to be only slightly smaller than the inside diameter of the first and second hydraulic cylinders 44, 45, thereby eliminating the necessity for sealing rings on the circumference of the rams and eliminating friction that would otherwise be caused by sealing rings. The proximal end of the first hydraulic ram 75 is rigidly attached to the right face of an air piston 77 by welding or other suitable means, so that the longitudinal axis of the first hydraulic ram 75 is collinear with the longitudinal axis of the air piston 77. The proximal end of the second hydraulic ram 76 is rigidly attached to the left face of the air piston 77 by welding or other suitable means, so that the longitudinal axis of the second hydraulic ram 76 is also collinear with the longitudinal axis of the air piston 77, forming a rigid assembly comprised of the first hydraulic ram 75, the air piston 77, and the second hydraulic ram 76. The air piston 77 is shown as having an outside diameter of $D_1$, and the outside diameter of the two hydraulic rams 75, 76 is shown as $D_2$. As described previously, the ratio of hydraulic fluid output pressure to air inlet pressure (or "hydraulic amplification") of the present invention may be calculated as function of the two diameters $D_1$ and $D_2$ shown in FIG. 9 as follows:

$$P_{hydraulic\ fluid}/P_{air}=(D_1^2-D_2^2)/D_2^2$$

In a preferred embodiment, the diameter of the air piston 77 is 10 inches, and the diameter of the first and second hydraulic rams 75, 76 is 1.875 inch, resulting in a pressure amplification of about 27.4. In alternative embodiments, other diameters of the air piston 77 and the first and second hydraulic rams 75, 76 may be selected to provide different values of pressure amplification.

Figure 10:
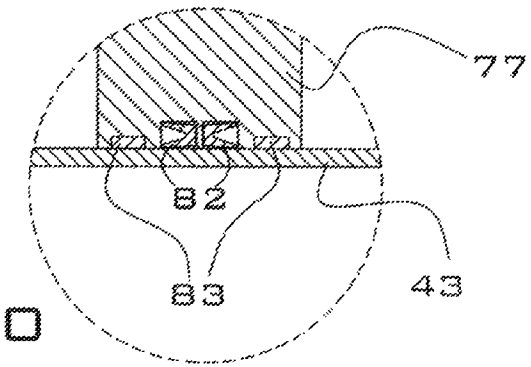
FIG. 10 is a magnified view of the sealing rings of the air cylinder of the present invention.

An air-tight seal between the air piston 77 and the inside wall of the air cylinder 43 is achieved with the sealing rings of the air piston 77, shown in detail in reference to FIG. 10. Hydraulic fluid (not shown) within the first hydraulic cylinder 44 is prevented from leaking into the right side of the air cylinder 43, and compressed air from the right side of the air cylinder 43 is prevented from leaking into the first hydraulic cylinder 44 by an inner pair of U-seals and an outer pair of O-rings in the first seal keeper 78 (shown in detail in FIG. 11). Similarly, hydraulic fluid within the second hydraulic cylinder 45 is prevented from leaking into the left side of the air cylinder 43, and compressed air from the left side of the air cylinder 43 is prevented from leaking into the second hydraulic cylinder 45 by an inner pair of U-seals and an outer pair of O-rings in the second seal keeper 79. As shown, the seal keepers 78, 79 may be easily and quickly removed and replaced if required by removing the threaded bolt assemblies 66 and disassembling the first and second end blocks 64, 65. This quick-replacement capability is an innovative feature of the present invention. First drip leg 73 and second drip leg 74 allow any liquids that are present within the air cylinder 43 to be expelled. The first air cylinder port 80 and the second air cylinder port 81 provide pathways for air to enter and exit the air cylinder 43, as described previously in reference to FIGS. 2 through 5.

In a preferred embodiment, the air cylinder 43 is made of nitride-hardened steel, the first and second hydraulic cylinders 44, 45 are made of suitable-to-hone steel, the air piston 77 is made of aluminum, and the first and second hydraulic rams 75, 76 are made of induction-hardened, chrome-plate steel.

FIG. 10 is a magnified longitudinal cross-section view of the bottom portion of the air piston 77 showing the circumferential sealing rings 82, 83. As shown, the air piston 77 comprises a pair of Buna-N (nitrile) U-seals 82 and pair of bronze-filled PTFE (polytetrafluoroethylene) wear bands 83.

Figure 11:
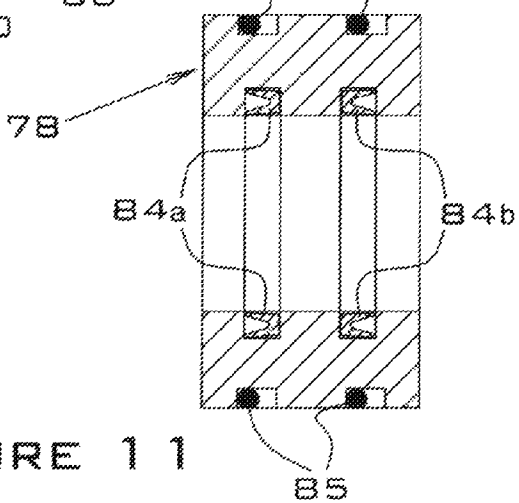
FIG. 11 is a magnified view of the seal keeper of the present invention.

FIG. 11 is a magnified longitudinal cross-section view of the first seal keeper 78 of the present invention. As shown, the first seal keeper 78 is in the form of a cylinder with a hollow core. Sealing elements include a pneumatic U-seal 84*a* and a hydraulic U-seal 84*b* positioned in grooves around the inside circumference of the seal keeper 78, and a pair of O-rings 85 positioned in grooves around the outside perimeter of the seal keeper 78. The pneumatic U-seal 84*a* forms a seal between the body of the seal keeper 78 and the first hydraulic ram 75 (shown in FIG. 9) that slides within the inside circumference of the seal keeper 78. The purpose of the pneumatic U-seal 84*a* is to prevent compressed air in the right side of the air cylinder 43 from leaking into the first hydraulic cylinder 44 (as shown in FIG. 9). The hydraulic U-seal 84*b* also forms a seal between the body of the seal keeper 78 and the first hydraulic ram 75. The purpose of the hydraulic U-seal 84*b* is to prevent hydraulic fluid in the first hydraulic cylinder 44 from leaking into the right side of the air cylinder 43. The outer O-rings 85 form a seal between the seal keeper 78 and the first end block 64 (shown in FIG. 9) and prevent compressed air and hydraulic fluid from leaking around the outside perimeter of the first seal keeper 78. The second seal keeper 79 is preferably identical to the first seal keeper 78.

FIG. 12 is a cross-section longitudinal view of the air cylinder and the plunger-operated pilot valves of the present invention taken at the center line of the plunger-operated pilot valves. As shown, the first plunger-operated pilot valve 53 is mounted within the first end block 64, and the second plunger-operated pilot valve 54 is mounted within the second end block 65 with air-tight threaded fittings. Inlet air is supplied to the first plunger-operated pilot valve 53 via a fifth pneumatic pilot line 86, and air is supplied to the second plunger-operated pilot valve 54 via a sixth pneumatic pilot line 87. When the first plunger-operated pilot valve 53 is activated (as shown in detail in the following FIGS. 13 through 15), it supplies compressed air to the first pneumatic pilot tube 58. When the second plunger-operated pilot valve 54 is activated (also as shown in the following FIGS. 13 through 15), it supplies compressed air to the third pneumatic pilot tube 60. In an alternative embodiment, solenoid-operated pilot valves may be used in place of the first and second plunger-operated pilot valves 75, 76.

Figure 13:
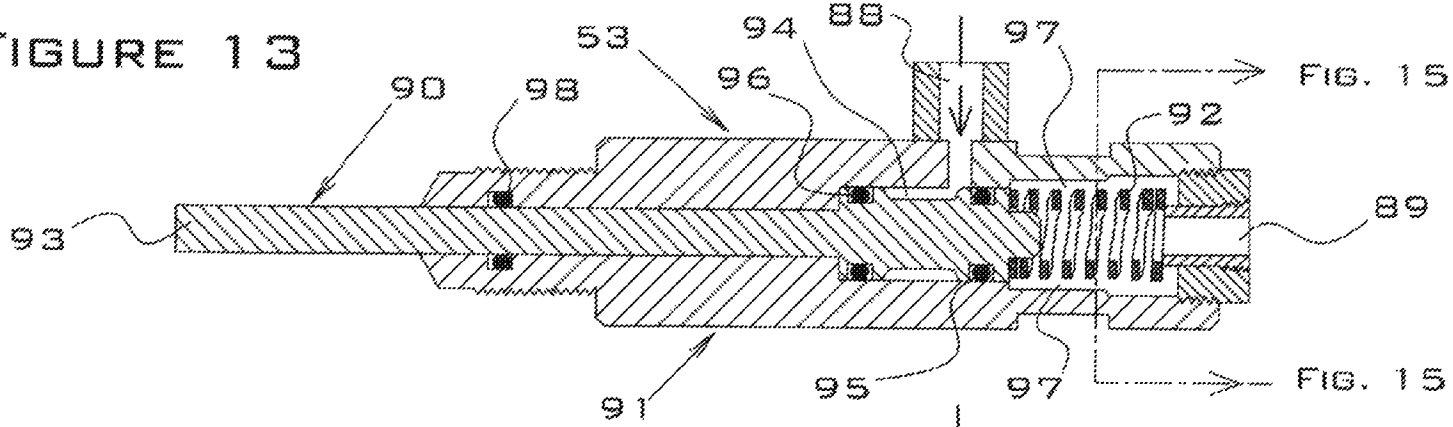
FIG. 13 is a magnified longitudinal cross-section view of a plunger-operated pilot valve, with the valve shown in the closed position.

FIG. 13 is a magnified longitudinal cross-section view of the first plunger-operated pilot valve 53, shown in the closed (or blocked) position. The first plunger-operated pilot valve 53 comprises an inlet port 88, an outlet port 89, a plunger 90, a barrel 91, and a compression spring 92. The plunger 90 comprises a push rod 93, an annular flow channel 94, a first O-ring 95 and a second O-ring 96. The barrel 91 comprises four flow channels 97, of which two are shown, and an O-ring 98. When the first plunger-operated pilot valve 53 is in the closed position, as shown in FIG. 13, compressed air (illustrated by the dashed arrow) that is applied to the inlet port 88 cannot pass through the first plunger-operated valve 53 because the flow channel 94 of the plunger is sealed off from the four flow channels 97 of the barrel (shown in more detail in FIG. 15) by the first O-ring 95. The plunger 90 is held in the closed position (pushed to the left as shown in FIG. 13) by force supplied by the compression spring 92. In a preferred embodiment, the plunger 90 and the barrel 91 of the first plunger-operated pilot valve 53 are made of type 304 stainless steel.

Figure 14:
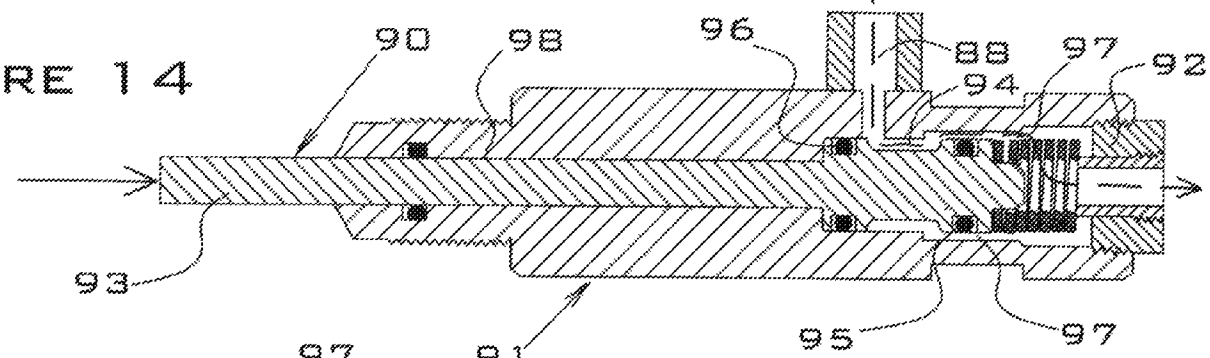
FIG. 14 is a magnified longitudinal cross-section view of a plunger-operated pilot valve, with the valve shown in the open position.

FIG. 14 is a magnified longitudinal cross-section view of the first plunger-operated pilot valve 53, shown in the open position. The first plunger-operated pilot valve 53 is activated when the push rod 93 of the plunger 90 is contacted by the air piston 77 (shown in FIG. 12), which causes the plunger 90 to overcome the force of the compression spring 92 and move to the right as shown in FIG. 14. When the plunger 90 has moved sufficiently toward the right, the flow channel 94 of the plunger becomes connected to the four the flow channels 97 of the barrel because first O-ring 95 has been displaced from its sealing position. At this time, compressed air is able to enter the inlet port 88, pass through the flow channels 94, 97, and exit through outlet port 89, as illustrated by the dashed arrow. O-rings 96 and 98 prevent compressed air from leaking around the circumference of the plunger 90.

Figure 15:
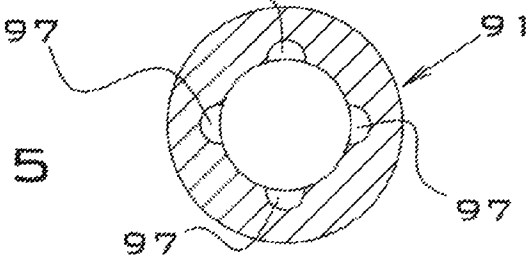
FIG. 15 is a cross-section axial view of a plunger-operated pilot valve showing the internal air flow channels within the barrel.

FIG. 15 is an axial cross-section view of the barrel 91 of the first plunger-operated pilot valve 53 showing the four flow channels 97 that are machined into the inner circumference of the barrel 91. The second plunger-operated pilot valve 54 is identical to the first plunger-operated pilot valve 53 and operates in an identical manner.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An air-to-hydraulic fluid pressure amplifier comprising:

(a) an air cylinder having an internal reciprocating air piston;

(b) a first hydraulic cylinder having a first valve fitting and a first internal hydraulic ram that is slidably positioned within the first hydraulic cylinder;

(c) a second hydraulic cylinder having a second valve fitting and a second internal hydraulic ram that is slidably positioned within the second hydraulic cylinder;

(d) a first flow control valve and a second flow control valve; and (e) a first plunger-operated pilot valve and a second plunger-operated pilot valve;

wherein a proximal end of the first hydraulic ram is rigidly attached to a first face of the air piston so that a longitudinal axis of the first internal hydraulic ram is collinear with a longitudinal axis of the air piston, and wherein a proximal end of the second internal hydraulic ram is rigidly attached to a second face of the air piston so that a longitudinal axis of the second hydraulic ram is collinear with the longitudinal axis of the air piston;

wherein when a first port of a directional control valve supplies compressed air to a pilot of the first flow control valve, the first control valve supplies air to a first side of the air cylinder via a first air cylinder port, thereby moving the air piston toward a second side of the air cylinder;

wherein as the air piston moves to the second side of the air cylinder, air present in the second side of the air cylinder is exhausted through a second air cylinder port and through the second flow control valve to atmosphere;

wherein movement of the air piston toward the second side of the air cylinder causes the first hydraulic ram to move toward the second side of the air cylinder, thereby pressurizing hydraulic fluid within the first hydraulic cylinder and forcing pressurized hydraulic fluid within the first hydraulic cylinder to exit the first hydraulic cylinder through a first hydraulic check valve and through a first external hydraulic line into external lift cylinders;

wherein movement of the air piston toward the second side of the air cylinder causes the second hydraulic ram to move toward the second side of the air cylinder, thereby drawing hydraulic fluid into the second hydraulic cylinder from a hydraulic reservoir through a second external hydraulic line and through a second hydraulic check valve;

wherein the air piston continues to move toward the second side of the air cylinder until it contacts a first plunger-operated pilot valve; and wherein the first plunger-operated pilot valve is an end-of-stroke sensor for the air piston.

2. The air-to-hydraulic fluid pressure amplifier of claim 1, wherein when the air piston comes into contact with the first plunger-operated pilot valve, the first plunger-operated pilot valve supplies compressed air to a first pneumatic pilot tube;

wherein the first pneumatic pilot tube is connected to a first pilot of the directional control valve;

wherein air pressure on the first pilot of the directional control valve causes the directional control valve to shuttle, thereby causing compressed air to be supplied from a second port of the directional control valve to a second pneumatic pilot tube that is connected to a pilot of the second flow control valve and causing compressed air to flow into the second side of the air cylinder through a first air supply pipe, through the second flow control valve, and through the second air cylinder port;

wherein the compressed air moving into the second side of the air cylinder causes the air piston to stop moving toward the second side of the air cylinder and to begin moving toward the first side of the air cylinder;

wherein as output of the compressed air shifts from the first port of the directional flow control valve to the second port of the directional control valve, air pressure is removed from the pilot of the first flow control valve, thereby causing internal components within the first flow control valve to shift an internal air flow path within the first flow control valve to a deactivated state; and wherein the shifting of the internal air flow path within the first flow control valve to a deactivated state allows compressed air in the first side of the air cylinder to exit the air cylinder through the first cylinder port and escape to atmosphere through an exhaust port of the first flow control valve.

3. The air-to-hydraulic fluid pressure amplifier of claim 2, wherein as compressed air enters the second side of the air cylinder, the air piston moves toward the first side of the air cylinder and away from the second side of the air cylinder;

wherein compressed air flows through second port of the directional control valve to the pilot of the second flow control valve, thereby causing the second control valve to supply compressed air to the second side of the air cylinder via the second air cylinder port;

wherein as the air piston moves toward the first side of the air cylinder, air that is in the first side of the air cylinder is exhausted to atmosphere through the first flow control valve via the first air cylinder port;

wherein movement of the air piston toward the first side of the air cylinder causes the second hydraulic ram to move toward the first side of the air cylinder, thereby pressurizing hydraulic fluid within the second hydraulic cylinder and forcing the pressurized hydraulic fluid to exit the second hydraulic cylinder through a third hydraulic check valve, through a third external hydraulic line, and into the external lift cylinders; and wherein movement of the air piston toward the first side of the air cylinder causes the first hydraulic ram to move toward the first side of the first hydraulic cylinder, thereby drawing hydraulic fluid into the first hydraulic cylinder from the hydraulic reservoir via a fourth external hydraulic line and through a fourth hydraulic check valve.

4. The air-to-hydraulic fluid pressure amplifier of claim 3, wherein movement of the air piston toward the first side of the air cylinder causes it to contact the second plunger-operated pilot valve, thereby causing the second plunger-activated pilot valve to supply compressed air to a third pneumatic pilot tube that is connected to a second pilot of the directional control valve;

wherein air pressure on the second pilot of the directional control valve causes the directional control valve to shuttle, thereby causing compressed air to be supplied from the first port of the directional control valve to a fourth pneumatic pilot tube that is connected to the pilot of the first flow control valve and causing compressed air to flow into the first side of the air cylinder through a second air supply pipe, through the first flow control valve, and through the first air cylinder port;

wherein the compressed air moving into the first side of the air cylinder causes the air piston to stop moving toward the first side of the air cylinder and begin moving toward the second side of the air cylinder;

wherein as output of the compressed air shifts from the second port of the directional flow control valve to the first port of the directional control valve, air pressure is removed from the pilot of the second flow control valve, thereby causing the second flow control valve to shift to a deactivated state; and wherein the shifting of the second flow control valve to a deactivated state allows compressed air in the second side of the air cylinder to exit the air cylinder via the second air cylinder port and escape to atmosphere through an exhaust port of the second flow control valve.

5. The air-to-hydraulic fluid pressure amplifier of claim 4, wherein an outlet of the first plunger-operated pilot valve is connected to the first pilot of the directional control valve by the first pneumatic pilot tube, and wherein an outlet of the second plunger-operated pilot valve is connected to the second pilot of the directional control valve by the third pneumatic pilot tube; and wherein the second port of the directional control valve is connected to the second flow control valve with the third pneumatic pilot tube, and the first port of the directional control valve is connected to the first flow control valve with the fourth pneumatic pilot tube.

6. The air-to-hydraulic fluid pressure amplifier of claim 3, wherein the first hydraulic check valve and the fourth hydraulic check valve are attached to a distal end of the first hydraulic cylinder with a first dual-port threaded valve fitting so that the first hydraulic check valve is connected parallel to a radial axis of the first hydraulic cylinder and the fourth hydraulic check valve is connected parallel to a longitudinal axis of the first hydraulic cylinder.

7. The air-to-hydraulic fluid pressure amplifier of claim 6, wherein the second hydraulic check valve and the third hydraulic check valve are connected to a distal end of the second hydraulic cylinder with a second dual-port valve fitting so that the second hydraulic check valve is connected parallel to a longitudinal axis of the second hydraulic cylinder and the third hydraulic check valve is connected parallel to a radial axis of the second hydraulic cylinder.

8. The air-to-hydraulic fluid pressure amplifier of claim 1, further comprising a first seal keeper and a second seal keeper, wherein the first seal keeper maintains a fluid-tight pressure seal between the air cylinder and the first and second hydraulic cylinders, and the second seal keeper maintains a fluid-tight pressure seal between the air cylinder and the first and second hydraulic rams.

9. The air-to-hydraulic fluid pressure amplifier of claim 8, wherein both of the first and second seal keepers are in the form of a cylinder with a hollow core.

10. The air-to-hydraulic fluid pressure amplifier of claim 1, further comprising a first end block that attaches the air cylinder to the first hydraulic cylinder and a second end block that attaches the air cylinder to the second hydraulic cylinder;

wherein the first plunger-operated pilot valve is installed into the first end block, and the second plunger-operated pilot valve is installed into the second end block.

11. The air-to-hydraulic fluid pressure amplifier of claim 1, further comprising a first drip leg and a second drip leg, both of which are mounted on a bottom side of the air cylinder, and both of which are moisture drain valves to drain fluids that accumulate on a bottom inside surface of the air cylinder.

12. The air-to-hydraulic fluid pressure amplifier of claim 1, wherein each of the first and second hydraulic rams has an outer diameter, and wherein the outer diameters of the first and second hydraulic rams are selected to provide a certain value of pressure amplification.

13. The air-to-hydraulic pressure amplifier of claim 1, wherein the first plunger-operated pilot valve comprise an inlet port, an outlet port, a plunger, a barrel, and a compression spring with a force;

wherein the plunger comprises a push rod and an annular flow channel;

wherein the barrel has four flow channels;

wherein the first plunger-operated pilot valve is activated when the push rod of the plunger is contacted by the air piston, thereby causing the plunger to overcome the force of the compression spring and to move; and wherein movement of the plunger causes the flow channel of the plunger to connect to the four flow channels of the barrel, thereby allowing compressed air to enter the inlet port, pass through the flow, channels of the plunger and the barrel, and exit through the outlet port.

14. The air-to-hydraulic pressure amplifier of claim 13, wherein the second plunger-operated pilot valve comprises an inlet port, an outlet port, a plunger, a barrel, and a compression spring with a force;

wherein the plunger comprises a push rod and an annular flow channel;

wherein the barrel has four flow channels;

wherein the second plunger-operated pilot valve is activated when the push rod of the plunger is contacted by the air piston, thereby causing the plunger to overcome the force of the compression spring and to move; and wherein movement of the plunger causes the flow channel of the plunger to connect to the four flow channels of the barrel, thereby allowing compressed air to enter the inlet port, pass through the flow channels of the plunger and the barrel, and exit through the outlet port.

* * * * *